United States Patent [19]

Niebylski

[11] 4,191,536

[45] Mar. 4, 1980

[54] FUEL COMPOSITIONS FOR REDUCING COMBUSTION CHAMBER DEPOSITS AND HYDROCARBON EMISSIONS OF INTERNAL COMBUSTION ENGINES

[75] Inventor: Leonard M. Niebylski, Birmingham, Mich.

[73] Assignee: Ethyl Corporation, Richmond, Va.

[21] Appl. No.: 927,496

[22] Filed: Jul. 24, 1978

[51] Int. Cl.[2] ..... C10L 1/14

[52] U.S. Cl. ..... 44/63; 44/68

[58] Field of Search ..... 44/63, 68; 260/346.11

[56] References Cited

U.S. PATENT DOCUMENTS

| | | | |
|---|---|---|---|
| 4,052,171 | 10/1977 | Niebylski | 44/68 |
| 4,067,699 | 1/1978 | Lukasiewicz | 44/68 |
| 4,082,517 | 4/1978 | Niebylski et al. | 44/68 |
| 4,105,677 | 8/1978 | Taylor | 260/346.11 |
| 4,124,600 | 11/1978 | Jenkin, Jr. | 260/346.11 |

*Primary Examiner*—Delbert E. Gantz
*Assistant Examiner*—Y. Harris-Smith
*Attorney, Agent, or Firm*—Donald L. Johnson; Robert A. Linn; Willard G. Montgomery

[57] ABSTRACT

Exhaust hydrocarbon emissions and combustion chamber deposits of an internal combustion engine being operated on gasoline containing a cyclopentadienyl manganese antiknock are reduced by the addition of a saturated cyclic ether, such as tetrahydrofuran.

21 Claims, No Drawings

FUEL COMPOSITIONS FOR REDUCING COMBUSTION CHAMBER DEPOSITS AND HYDROCARBON EMISSIONS OF INTERNAL COMBUSTION ENGINES

BACKGROUND OF THE INVENTION

Fuels used in today's automotive engines cause deposits to be formed during combustion. Such deposits collect on parts of the combustion chamber including valves, spark plugs, cyclinder heads and walls. Formation of these deposits can result in increased exhaust emissions.

Cyclopentadienyl manganese compounds are excellent antiknocks in gasolines used to operate internal combustion engines and have proven to be especially beneficial in solving some of the problems present when low-lead or lead-free gasolines are used with internal combustion engines. Use of such compounds as antiknocks is described in U.S. Pat. Nos. 2,818,417, 2,839,552 and 3,127,351 all incorporated herein by reference.

The use of various ethers in fuels to reduce knocking of the fuel or to reduce carbon monoxide emissions is also known. U.S. Pat. No. 2,409,746 discloses the use of certain asymmetrical dialkyl ethers, particularly methyl tetriary butyl ether in motor fuel to reduce the knocking of the fuel in supercharged gasoline engines. Roselle discloses in U.S. Pat. No. 2,046,243 the use of branched ethers, particularly isopropyl ether, in motor fuel to reduce knocking of the engine. U.S. Pat. No. 3,820,962 discloses a fuel additive composition comprising a major amount of white oil and minor amounts of a dialkyl ether and oil of orange effective for reducing carbon monoxide emissions from the combustion of a hydrocarbon fuel in an internal combustion engine. U.S. Pat. No. 2,952,612 discloses a process for improving the effectiveness of high octane materials such as saturated alkyl ethers in combination with catalytically cracked gasoline in automotive fuels.

SUMMARY OF THE INVENTION

According to the present invention, exhaust hydrocarbon emissions and combustion chamber deposits of internal combustion engines operating on gasoline containing cyclopentadienyl manganese antiknock compounds are reduced by gasoline compositions containing a saturated cyclic ether, such as tetrahydrofuran.

DESCRIPTION OF THE PREFERRED EMBODIMENT

The essence of the present invention resides in the reduction of exhaust emissions and engine deposits of internal combustion engines which burn gasoline containing an organomanganese compound. This reduction in exhaust emission is effected by addition to the gasoline of a saturated cyclic ether wherein ether oxygen is in a ring with carbon atoms, such as tetrahydrofuran. Accordingly, a preferred embodiment of the present invention is an improved gasoline composition suitable for use in a spark ignited internal combustion engine and containing an amount of organomanganese compound, preferably a cyclopentadienyl manganese tricarbonyl, and most preferably methylcyclopentadienyl manganese tricarbonyl sufficient to increase the gasoline's antiknock effectiveness, and also containing an exhaust emission and engine deposit reducing amount of a saturated cyclic ether, such as tetrahydrofuran.

A further embodiment of the present invention is a method for reducing exhaust emissions and engine deposits of a spark ignited internal combustion engine which operates on gasoline containing an organomanganese compound, preferably a cyclopentadienyl manganese tricarbonyl, and most preferably methylcyclopentadienyl manganese tricarbonyl sufficient to improve the antiknock characteristics of the gasoline, by the addition to the gasoline of an exhaust emission and engine deposit reducing amount of a saturated cyclic ether, such as tetrahydrofuran.

Since the invention also embodies the operation of an internal combustion engine in a manner which results in the reduction of exhaust emissions and engine deposits, a still further embodiment is a method of operating a spark ignited internal combustion engine using a gasoline containing an organomanganese, preferably a cyclopentadienyl manganese tricarbonyl, and most preferably methylcyclopentadienyl manganese tricarbonyl antiknock which results in the reduction of exhaust emissions and engine deposits, said method comprising (a) supplying to the fuel induction system of said engine a gasoline containing an organomanganese antiknock and a gasoline soluble solution of a saturated cyclic ether, such as tetrahydrofuran, (b) mixing said gasoline with air, (c) inducting the mixture into the combustion chambers of said engine, (d) compressing said mixture, (e) igniting said compressed mixture, and (f) exhausting the resultant combustion products through said combustion chambers.

Liquid hydrocarbon fuels of the gasoline boiling range are mixtures of hydrocarbons having a boiling range of from about 80° F. to about 430° F. Of course, these mixtures can contain individual constituents boiling above or below these figures. These hydrocarbon mixtures contain aromatic hydrocarbons, saturated hydrocarbons and olefinic hydrocarbons. The bulk of the hydrocarbon mixture is obtained by refining crude petroleum by either straight distillation or through the use of one of the many know refining processes, such as thermal cracking, catalytic cracking, catalytic hydroforming, catalytic reforming, and the like. Generally, the final gasoline is a blend of stocks obtained from several refinery processes. The final blend my also contain hydrocarbons made by other procedures such as alkylate made by the reaction of $C_4$ olefins and butanes using an acid catalyst such as sulfuric acid or hydrofluoric acid.

Preferred gasolines are those having a Research Octane Number of at least 85. A more preferred Research Octane Number is 90 or greater. It is also preferred to blend the gasoline such that it has a content or aromatic hydrocarbons ranging from 10 to about 60 volume percent, an olefinic hydrocarbon content ranging from 0 to about 30 volume percent, and a saturated hydrocarbon content ranging from about 40 to 80 volume percent, based on the whole gasoline.

In order to obtain fuels having properties required by modern automotive engines, a blending procedure is generally followed by selecting appropriate blending stocks and blending them in suitable proportions. The required octane level is most readily accomplished by employing aromatics (e.g. BTX, catalytic reformate or the like), alkylate (e.g. $C_{6-9}$ saturates made by reacting $C_4$ olefins with isobutane using HF or $H_2SO_4$ catalyst), or blends of different types.

The balance of the whole fuel may be made up of other components such as other saturates, olefins, or the like. The olefins are generally formed by using such procedures as thermal cracking, catalytic cracking and polymerization. Dehydrogenation of paraffins to olefins can supplement the gaseous olefins occurring in the refinery to produce feed material for either polymerization or alkylation processes. The saturated gasoline components comprise paraffins and naphthenates. These saturates are obtained from (1) virgin gasoline by distillation (straight run gasoline), (2) alkylation processes (alkylates) and (3) isomerization procedures (conversion of normal paraffins to branched chain paraffins of greater octane quality). Saturated gasoline components also occur in so-called natural gasolines. In addition to the foregoing, thermally cracked stocks, catalytically cracked stocks and catalytic reformates contain saturated components.

The classification of gasoline components into aromatics, olefins and saturates is well recognized in the art. Procedures for analyzing gasolines and gasoline components for hydrocarbon composition have long been known and used. Commonly used today is the FIA analytical method involving fluorescent indicator adsorption techniques. These are based on selective adsorption of gasoline components on an activated silica gel column. The components being concentrated by hydrocarbon type in different parts of the column. Special fluorescent dyes are added to the test sample and are also selectively separated with the sample fractions to make the coundaries of the aromatics, olefins and saturates clearly visible under ultraviolet light. Further details concerning this method can be found in "1969 Book of ASTM Standards," January 1969 Edition, under ASTM Test Designation D 1319-66T.

The motor gasolines used in formulating the improved fuels of this invention generally have initial boiling points ranging from about 80° to about 105° F. and final boiling points ranging from about 380° to about 430° F. as measured by the standard ASTM distillation procedure (ASTM D-86). Intermediate gasoline fractions boil away at temperatures within these extremes.

From the standpoint of minimizing atmospheric pollution to the greatest extent possible, it is best to keep the olefin content of the fuel as low as can be economically achieved as olefins reportedly give rise to smog-forming emissions, especially from improperly adjusted vehicular engines. Accordingly, in the preferred base stocks of this invention the olefin content will not exceed about 10 volume percent and the most particularly preferred fuels will not contain more than about 5 percent olefins. Table 1 illustrates the hydrocarbon type makeup of a number of particularly preferred fuels for use in this invention.

TABLE I

Hydrocarbon Blends of Particularly Preferred Base Fuels

| Fuel | Aromatics | Volume Percentage Olefins | Saturates |
|---|---|---|---|
| A | 35.0 | 2.0 | 63.0 |
| B | 40.0 | 1.5 | 58.5 |
| C | 20.0 | 2.5 | 77.5 |
| D | 33.5 | 1.0 | 65.5 |
| E | 36.5 | 2.5 | 61.0 |
| F | 43.5 | 1.5 | 55.0 |
| G | 49.5 | 2.5 | 48.0 |

It is also desirable to utilize base fuels having a low sulfur content as the oxides of sulfur tend to contribute an irritating and choking character to smog and other forms of atmospheric pollution. Therefore, to the extent it is economically feasible, the fuel will contain not more than about 0.1 weight percent of sulfur in the form of conventional sulfur-containing impurities. Fuels in which the sulfur content is no more than about 0.22 weight percent as especially preferred for use in this invention.

Normally the gasoline to which this invention is applied is lead-free or substantially lead-free, although small amounts or organolead additives usually employed to give fuels of improved performance quality such as tetraalkyllead antiknocks including tetramethyllead, tetraethyllead, physical or redistributed mixtures of tetramethyllead and tetraethyllead, and the like may be present therein. The gasoline may also contain antiknock quantities of other agents such as cyclopentadienyl nickel nitrosyl, N-methyl aniline, as well as the various aforementioned ethers such as methyl tetriary butyl ether. Antiknock promoters such as tert-butyl acetate may be included. The gasoline may further contain blending agents or supplements such as methanol, ethanol, isopropanol, tert-butanol and the like. Antioxidants such as 2,6-di-tert-butylphenol, 2,6-di-tert-butyl-p-cresol, phenylenediamines such as N,N'-di-sec-butyl-p-phenylenediamine, N-isopropylphenylenediamine, and the like, may be present. Likewise, the gasoline can contain dyes, metal deactivators, or other types of additives recognized to serve some useful purpose in improving the gasoline quality.

Cyclopentadienyl manganese tricarbonyls are known antiknocks and their preparation and use are described in U.S. Pat. Nos. 2,818,417, 2,839,552, and 3,127,351. An important antiknock of this type is methylcyclopentadienyl manganese tricarbonyl. The amount of the cyclopentadienyl manganese tricarbonyl added to the gasolines should be an amount adequate to increase its antiknock effectiveness. This has generally been found to be in the range of from about 0.005 to 10 grams per gallon of manganese as a cyclopentadienyl manganese tricarbonyl. A preferred range is from about 0.05 to 6 grams of manganese per gallon as a cyclopentadienyl manganese tricarbonyl. A more preferred range is from about 0.05 to about 0.25 grams of manganese per gallon, and a most preferred range is from about 0.05 to about 0.125 grams of manganese per gallon as methylcyclopentadienyl manganese tricarbonyl.

The saturated cyclic ether component of the present invention is preferably tetrahydrofuran. Tetrahydrofuran is a colorless liquid having a melting point of −108.5° C. and a boiling point of 65° C.–67° C. It is widely used as a solvent for high-molecular polyvinyl chloride and other difficulty soluble organic materials. Tetrahydrofuran may be produced by a number of different methods, the more prominent among them being the dehydration of 1,4-butanediol and the catalytic hydrogenation of furan. Most tetrahydrofuran is, in fact, manufactured in a multi-step sequence starting with the reaction of acetylene and formaldehyde in the presence of cuprous acetylide complex to form butynediol. The butyne diol is hydrogenated to butanediol, which is dehydrated to tetrahydrofuran as indicated above. In addition, tetrahydrofuran can be prepared by catalytic hydrogenation of maleic, fumaric and succinic acids, their respective anhydrides and ester derivatives, and butyrolactone. More recently, Smith, in U.S. Pat. No. 4,010,171, discloses a method for making tetrahydrofuran by heating a carboxylic acid diester of 1,4-butanediol in the vapor phase in the presence of water and a hydrolysis-dehydroacyloxylation catalyst, and in U.S. Pat. No. 4,011,244, by heating a carboxylic acid monoester of 1,4-butanediol in the vapor phase in the presence of a dehydroacyloxylation catalyst.

Other higher boiling cyclic ethers wherein ether-oxygen is in a ring with carbon atoms, such as, for example, 4,4-dimethyl-1,3-dioxane, tetrahydropyran, as well as many of the substituted tetrahydrofurans, such as, for example, 2-methyltetrahydrofuran, 2-ethyltetrahydrofuran, and 3-methyltetrahydrofuran may also find use in the present invention. In order to be most advantageously employed as hydrocarbon emission and engine deposit reducing agents, the above compounds should be readily soluble, either directly or indirectly, in the gasoline.

The amounts of hydrocarbon emission control additive compound, tetrahydrofuran, to reduce the hydrocarbon emission and engine deposit level is at least to some extent dependent upon the amount of manganese present in the gasoline. Generally, the greater the concentration of manganese, the greater the amount of additive compound needed to reduce deposit related hydrocarbon emission levels. A typical concentration range is from about 15.0 grams per gallon to about 100 grams per gallon. It is to be understood that concentrations somewhat outside this range can be used if desired. The particularly preferred amount of compound is about 15.0–30.0 grams per gallon. There is no real known upper limit on the concentration of the hydrocarbon emission and engine reducing compound. In general, one uses an additive quantity having adequate exhaust reducing and engine deposit reducing properties.

The following examples, in which all parts are by weight, illustrate the preparation of the products of this invention.

EXAMPLE I

To a blending vessel was added 30 gallons of a reformate gasoline having the following properties:

| | |
|---|---|
| Boiling range | 87–408° F. |
| Research octane number | 93 |
| Aromatics (volume percent) | 28.5 |
| Olefinics (volume percent) | 8.0 |
| Aliphatics (volume percent) | 63.5 |

To this gasoline was added an amount of methylcyclopentadienyl manganese tricarbonyl sufficient to provide 0.125 grams of manganese per gallon of fuel. There was then added to the gasoline a sufficient amount of the aforedescribed tetrahydrofuran to give a concentration of 15.0 grams per gallon of fuel. The mixture was then agitated until thoroughly mixed. The result was a gasoline having reduced emission and engine deposit increasing properties.

EXAMPLE 2

The preparation of Example 1 was repeated and a product was obtained having an amount of methylcyclopentadienyl manganese tricarbonyl sufficient to provide 0.125 grams of manganese per gallon of fuel and sufficient tetrahydrofuran to give a concentration of 30.0 grams per gallon of fuel.

EXAMPLE 3

The preparation of Example 1 was repeated and a product was obtained having an amount of methylcyclopentadienyl manganese tricarbonyl sufficient to provide 0.125 grams of manganese per gallon of fuel and sufficient tetrahydrofuran to give a concentration of 60.0 grams per gallon of fuel.

Tests were run to illustrate the unusual and beneficial effects of the products of this invention on reducing exhaust emissions. In such tests, an Oldsmobile-type single cyclinder engine with a 9.5:1 compression ratio is used, using Shell 10W-40 multigrade oil and a 28.5 percent aromatic fuel produced by Amoco and designated Amoco 91 containing 0.125 grams per gallon of fuel of methylcyclopentadienyl manganese tricarbonyl antiknock.

Engine Preparation.

Before each test, the combustion chamber valves and valve parts are cleaned of deposits and the valves are reseated. The old oil is drained, the oil pan is flushed with new oil and then filled with new oil. A new AC-45 spark plug is installed and the fuel lines are flushed with test fuel.

Start of Test Procedure.

The engine is started on the aforementioned Amoco 91 fuel from a fuel burette, at 50 percent wide open throttle, at a speed of 1370 r.p.m., an air/fuel ratio of about 14.7:1 and with an ignition timing of 10 BTC. These conditions are maintained until the water and oil sump are at 160±5° F. and the carburetor air is at 110±5° F. At this condition exhaust measurements are made for hydrocarbon and carbon monoxide so as to detect any engine changes compared to other tests in the same engine. Hydrocarbon measurements are made with a Beckman 400 Flame Ionization Hydrocarbon Detector. Carbon monoxide is measured with a Beckman 315A Non-Dispersive Infared Analyzer. Measurements are taken at approximately 8–10 inches downstream from the engine exhaust port.

The engine is then switched to the test fuel and the air/fuel ratio is adjusted to the stoichiometric air/fuel ratio required by the test fuel. At this time exhaust hydrocarbon emission measurements are made, giving a start-of-test-result, whereupon the engine is shut down and the oil level zeroed.

Time Accumulation Schedule.

The engine is restarted with test fuel on a cycling schedule alternating between the following conditions:

| | | |
|---|---|---|
| Time, seconds | 45 | 135 |
| Speed, r.p.m. | 750–850 | 1,370 |
| Load | None | 50 percent W.O.T.[1] |
| Air/Fuel Ratio | 14.2 | Stoichiometric |
| Ignition Timing | | 10° BTC |
| Oil Sump, °F. | | 165 ± 5 |
| Water, °F. | | 170 ± 5 |
| Carburetor Air, °F. | | 110 ± 5 |

[1]Wide Open Throttle

The test is run for 100 hours with emission measurements made every 24 hours.

Periodic Emission Ratings.

After about each 24 hours of test time, hydrocarbon emission measurements are taken at 50 percent W.O.T. after which the engine is returned to the cycling schedule.

End of Test Procedure.

At the end of 100 hours of test, hydrocarbon emission measurements are taken at 50 percent W.O.T. and the engine is returned to a cycling schedule for a 1-2 hour period and then shut down. Oil consumption is then measured in ml/hr.

Using this procedure, the following results in terms of the percent of reduction in exhaust hydrocarbon emission and total combustion chamber deposits were obtained using the emission reducing products of Examples 1, 2, and 3.

TABLE II

| Additive | Concentration, g. Tetrahydrofuran/g.fuel | Reduction of Emission Increase % Measured | Deposit Weight* (g.) |
|---|---|---|---|
| Product of Example 1 | 15.0 | 10 | 2.03 |
| Product of Example 2 | 30.0 | 22 | 2.31 |
| Product of Example 3 | 60.0 | 32 | 2.13 |
| Baseline | 0 | 100 | 2.44 |

*Deposit weights are average deposit weights obtained from six specific areas of the engine combustion chamber.

As these results show, the emission reducing additives of the present invention effectively reduce exhaust emissions and engine deposits from engines operating on gasoline containing cyclopentadienyl manganese antiknock. The results also indicate that the emission reducing additives of the present invention will effectively reduce exhaust emissions and engine deposits from engines operating on gasoline containing cyclopentadienyl manganese antiknock having up to 17 carbon atoms when the manganese concentration in the gasoline is present in an amount of from about 0.005 to 10 grams per gallon of manganese as a cyclopentadienyl manganese tricarbonyl and the concentration of tetrahydrofuran additive in the gasoline is present in an amount of from about 15.0 grams per gallon to about 100 grams per gallon.

I claim:

1. As a composition of matter, a gasoline for a spark ignited internal combustion engine comprising a mixture of (i) hydrocarbons boiling within the gasoline range, (ii) a cyclopentadienyl manganese tricarbonyl antiknock compound wherein said cyclopentadienyl is a hydrocarbon group having from 5 to 17 carbon atoms in an amount sufficient to improve the antiknock characteristics of said gasoline, and (iii) an exhaust emission and engine deposit reducing amount of tetrahydrofuran.

2. The composition of claim 1 wherein said cyclopentadienyl is methylcyclopentadienyl.

3. The composition of claim 2 containing from about 0.005 to about 10.0 grams of manganese per gallon as methylcyclopentadienyl manganese tricarbonyl.

4. The composition of claim 3 containing from about 0.05 to about 6.0 grams of manganese per gallon of gasoline as methycyclopentadienyl manganese tricarbonyl.

5. The composition of claim 4 containing from about 0.05 to about 0.125 grams of manganese per gallon of gasoline as methylcyclopentadienyl manganese tricarbonyl.

6. The composition of claim 1 containing from about 15.0 to about 100.0 grams per gallon of gasoline of tetrahydrofuran.

7. The composition of claim 6 containing from about 15.0 to about 60.0 grams per gallon of gasoline of said tetrahydrofuran.

8. A method for reducing engine deposits and exhaust emissions from a spark ignited internal combustion engine that operated on a gasoline comprising (i) a mixture of hydrocarbons within the gasoline boiling range and (ii) a cyclopentadienyl manganese tricarbonyl antiknock compound wherein said cyclopentadienyl is a hydrocarbon group having from 5 to 17 carbon atoms in an amount sufficient to improve the antiknock characteristics of said gasoline which method comprises adding to said gasoline an exhaust emission and engine deposit reducing amount of tetrahydrofuran.

9. The method of claim 8 wherein said cyclopentadienyl group is methylcyclopentadienyl.

10. The method of claim 9 wherein the amount of said methycyclopentadienyl manganese tricarbonyl is sufficient to provide from about 0.005 to about 10 grams of manganese per gallon of gasoline.

11. The method of claim 10 wherein the amount of said methylcyclopentadienyl manganese tricarbonyl is sufficient to provide from about 0.05 to about 6.0 grams of manganese per gallon of gasoline.

12. The method of claim 11 wherein the amount of said methylcyclopentadienyl manganese tricarbonyl is sufficient to provide from about 0.05 to about 0.125 grams of manganese per gallon of gasoline.

13. The method of claim 8 wherein said engine deposit and exhaust emission reducing amount of said tetrahydrofuran is from about 15.0 to about 100.0 grams per gallon of gasoline.

14. The method of claim 13 wherein said engine deposit and exhaust emission reducing amount of said tetrahydrofuran is from about 15.0 to about 60.0 grams per gallon of gasoline.

15. A method of operating a spark ignited combustion engine using a gasoline containing an organomanganese antiknock which results in the reduction of exhaust emissions and engine deposits, said method comprising (a) supplying to the fuel induction system of said engine a gasoline containing an antiknock amount of a cyclopentadienyl manganese tricarbonyl antiknock wherein said cyclopentadienyl is a hydrocarbon group having from 5 to 17 carbon atoms and a gasoline soluble solution of a saturated cyclic ether such as tetrahydrofuran, (b) mixing said gasoline with air, (c) inducting the mixture into the combustion chamber of said engine, (d) compressing said mixture, (e) igniting said compressed mixture, and (f) exhausting the resultant combustion products through said combustion chambers.

16. The method of claim 15 wherein cyclopentadienyl is methylcyclopentadienyl.

17. The method of claim 16 wherein the amount of said methylcyclopentadienyl manganese tricarbonyl is sufficient to provide from about 0.005 to about 10 grams of manganese per gallon of gasoline.

18. The method of claim 17 wherein the amount of said methylcyclopentadienyl manganese tricarbonyl is sufficient to provide from about 0.05 to about 6.0 grams of manganese per gallon of gasoline.

19. The method of claim 18 wherein the amount of said methylcyclopentadienyl manganese tricarbonyl is sufficient to provide from about 0.05 to about 0.125 grams of manganese per gallon of gasoline.

20. The method of claim 15 wherein said engine deposit and exhaust emission reducing amount of said tetrahydrofuran is from about 15.0 to about 100.0 grams per gallon of gasoline.

21. The method of claim 20 wherein said engine deposit and exhaust emission reducing amount of said tetrahydrofuran is from about 15.0 to about 60.0 grams per gallon of gasoline.

* * * * *